US008296000B2

(12) United States Patent
Denny et al.

(10) Patent No.: US 8,296,000 B2
(45) Date of Patent: Oct. 23, 2012

(54) TRACKING ROLLING STOCK IN A CONTROLLED AREA OF A RAILWAY

(75) Inventors: Joseph M. Denny, Fairport, NY (US); Michael J. Penza, Webster, NY (US); Andrew Kunzmann, Fairport, NY (US); Sean Gleeson, Pittsford, NY (US)

(73) Assignee: Railcomm, LLC, Fairport, NY (US)

( * ) Notice: Subject to any disclaimer, the term of this patent is extended or adjusted under 35 U.S.C. 154(b) by 233 days.

(21) Appl. No.: 12/877,625

(22) Filed: Sep. 8, 2010

(65) Prior Publication Data

US 2012/0056042 A1 Mar. 8, 2012

(51) Int. Cl.
*B61L 25/02* (2006.01)
*B61B 1/00* (2006.01)

(52) U.S. Cl. ..... 701/19; 104/26.1

(58) Field of Classification Search ..... None
See application file for complete search history.

(56) References Cited

U.S. PATENT DOCUMENTS

| | | | |
|---|---|---|---|
| 3,046,394 | A | 7/1962 | Mishelevich et al. |
| 4,659,043 | A | 4/1987 | Gallagher |
| 4,928,910 | A | 5/1990 | Utterback et al. |
| 5,060,890 | A | 10/1991 | Utterback et al. |
| 5,253,830 | A | 10/1993 | Nayer et al. |
| 5,438,322 | A | 8/1995 | Martin et al. |
| 5,633,628 | A | 5/1997 | Denny et al. |
| 6,390,419 | B2 | 5/2002 | Nicolette et al. |
| 6,516,727 | B2 | 2/2003 | Kraft |
| 6,556,898 | B2 | 4/2003 | Clawson |
| 6,637,703 | B2 | 10/2003 | Matheson et al. |
| 6,663,053 | B1 | 12/2003 | Shams |
| 6,759,963 | B2 | 7/2004 | Hayes |
| 6,899,303 | B2 | 5/2005 | Shams |
| 7,076,343 | B2 | 7/2006 | Kornick et al. |
| 7,257,471 | B2 | 8/2007 | Kornick et al. |
| 7,416,159 | B2 | 8/2008 | Beaman et al. |
| 7,457,691 | B2 | 11/2008 | Muinonen et al. |
| 7,688,218 | B2 | 3/2010 | LeFebvre et al. |
| 7,698,962 | B2 | 4/2010 | LeFebvre et al. |
| 7,705,743 | B2 | 4/2010 | Barone et al. |
| 2003/0058119 | A1 | 3/2003 | McAllister |
| 2005/0015185 | A1 | 1/2005 | Klemm |
| 2005/0145753 | A1 | 7/2005 | Beaman et al. |

(Continued)

FOREIGN PATENT DOCUMENTS

EP 2090491 A1 8/2009

OTHER PUBLICATIONS

SOFTRAIL: AI2006 Network Yard AEI Reader System (62 pages) dated Nov. 1, 2007.

(Continued)

*Primary Examiner* — Michael J. Zanelli
(74) *Attorney, Agent, or Firm* — Brian B. Shaw; Harter Secrest & Emery LLP

(57) ABSTRACT

A system for monitoring the location of rolling stock within a controlled area of a railway system is provided. The system includes a plurality of axle counters within the controlled area, wherein the axle counts are associated with a global sequence identifier. A central controller processes the axle counts and associated global sequence identifier in conjunction with a list of rolling stock entering the controlled area to provide a real time map of the location of each piece of rolling stock within the controlled area.

23 Claims, 3 Drawing Sheets

U.S. PATENT DOCUMENTS

| | | | | |
|---|---|---|---|---|
| 2007/0137514 | A1 | 6/2007 | Kumar et al. | |
| 2007/0179688 | A1 | 8/2007 | Muinonen et al. | |
| 2008/0195265 | A1 | 8/2008 | Searle et al. | |
| 2011/0017693 | A1* | 1/2011 | Thomas et al. | 212/270 |
| 2011/0282540 | A1 | 11/2011 | Armitage et al. | |

OTHER PUBLICATIONS

SOFTRAIL: AEI Rail & Road Manager—User Manual (92 pages) dated Apr. 2, 2007.

RailComm to add Shove Track detection system at CSX Erwin Terminal article (Feb. 5, 2010) http:\\www.railcomm.com/news/pr-01-26-2010.php.

PCT Notification of Transmittal of the International Search Report and the Written Opinion of the International Searching Authority, or the Declaration; dated Mar. 12, 2012 (2 pages), in corresponding International Patent Application No. PCT/US2011/049044 filed Aug. 25, 2011.

PCT International Search Report dated Mar. 12, 2012 (4 pages), in corresponding International Patent Application No. PCT/US2011/049044 filed Aug. 25, 2011.

PCT Written Opinion of the International Searching Authority dated Mar. 12, 2012 (4 pages), in corresponding International Patent Application No. PCT/US2011/049044 filed Aug. 25, 2011.

* cited by examiner

TRACKING ROLLING STOCK IN A CONTROLLED AREA OF A RAILWAY

CROSS-REFERENCE TO RELATED APPLICATIONS

Not applicable.

STATEMENT REGARDING FEDERALLY SPONSORED RESEARCH OR DEVELOPMENT

Not applicable.

THE NAMES OF THE PARTIES TO A JOINT RESEARCH AGREEMENT

Not applicable.

REFERENCE TO A "SEQUENCE LISTING"

Not applicable.

BACKGROUND OF THE INVENTION

1. Field of the Invention

The present disclosure relates to the tracking of rolling stock, including railcars and locomotives, and more particularly to the tracking of rolling stock within a controlled area of a railway system, wherein a passage of an axle or wheel is determined within the controlled area and the passage is associated with a corresponding piece of rolling stock within the controlled area, thus locating the rolling stock within the controlled area.

2. Description of the Related Art

A railroad system often includes at least one switchyard in which rolling stock, such as railcars, are routed from tracks leading from a departure point to tracks going to a destination point. A typical switchyard has four main components, namely receiving tracks, a railcar switching operation, a set of classification tracks and a set of departure tracks. Incoming trains deliver the railcars to the receiving tracks. The railcars are processed by the switching operation that routes individual railcars to respective classification tracks. From the classification tracks, the railcars are selectively assembled into trains on the departure tracks.

Two types of switching operations are typically used. The first one is a hump switching. Switch yards that use hump switching are referred to as hump yards. Hump switching uses a hump over which a railcar is pushed by a locomotive. At the top of the hump, the railcar is allowed to roll on the other side of the hump under the effect of gravity. Retarders keep the railcar from reaching excessive speeds. The hump tracks on which the railcar rolls down the hump connect with the classification tracks. One or more track switches establish a temporary connection between the hump tracks and a selected one of the classification tracks such that the railcar can roll in the classification tracks. A departure train is constituted when the requisite number of railcars has been placed in a set of classification tracks. When the departure train leaves the switchyard, the set of classification tracks become available for building a new departure train.

The second type of switching operation is flat switching. The principle is generally the same as a hump yard except that instead of using gravity to direct railcars to selected classification tracks, a locomotive is used to move the railcar from the receiving tracks to the selected set of classification tracks.

However, as switch yards can include tens or hundreds of receiving, classification and departure tracks wherein hundreds or thousands of railcars may pass through each day, the tracking of the railcars represents a significant task, aside from the physical disposition of the railcars themselves.

In addition, railcars carrying intermodal containers can enter the switch yard in the form of a train. Once the train enters the switch yard, the railcars are separated and routed to different storage, maintenance and/or processing tracks. Once a railcar is placed on a processing track, the containers need to be unloaded from the railcar.

A container management system such as provided by APS Technology Group is known. There are two major functions provided by the container management system. The first function provided by the APS system is to capture information about a train entering (or leaving) the switch yard at specific "portal" locations. The second function is to provide location information to the crane system for the purpose of "identifying" specific containers to be unloaded.

However, due to numerous tracks and combinations of switching moves between tracks within the switch yard, the ordering, orientation and locations of individual railcars becomes non-deterministic from the original train information captured by the APS system at the entrance portals. In order to facilitate remote control and automation of the container unloading, a method to track the location of the railcars that are carrying the containers is required.

Therefore, the need exists for a system of tracking the location of rolling stock, such as railcars, within a controlled area of a railway system. The need also exists for a system of tracking within a controlled area, wherein the resolution of the rolling stock location can be tailored to the particular controlled area.

The need also exists for rolling stock tracking capability that can provide the location of all the rolling stock, as to a specific track and ordering and orientation of the rolling stock on the specific track rather than an exact distance to a reference point within the controlled area. Further, it would be advantageous for the rolling stock location to be employed for any of a variety of purposes such as to a secondary operating system, such as the container management system.

BRIEF SUMMARY OF THE INVENTION

The present system contemplates a plurality of axle counters within a controlled area of a railway system, wherein the axle counters count or detect the individual wheels or axles of passing rolling stock such that the results are then communicated to a field controller or a central controller along with a global sequence identifier associated with the count. In one configuration, the communication occurs over a parallel or serial communication bus such as an RS-485 communication network, wherein in one configuration each field controller compiles the results from individual axle counters associated with a track zone and transmits the location related results to a central controller. The central controller processes the raw count data and compares the information with previously compiled railcar data provided by other data sources such as a railroads car management database or direct generation from a local RFID reader. With the combination of data, the central controller associates actual railcar identification information with detected locations of specific railcars (via the axle counts) and constantly updates a graphical user interface, database and external services interface with the latest derived data.

The central controller provides for track zone specific individual railcar/engine metrics such as (a) accumulated time at a current location (or track zone); (b) accumulated time at all locations within the controlled area; (c) number of times the railcar has been moved within the controlled area. Thus, crews can be assigned based on work order priority, railcar location and crew location.

The central controller can also produce alarms and or warnings if a railcar within the controlled area triggers a predetermined handling threshold. For instance, if a freight car with perishables is not processed in time, or a previously lost freight car appears in the system, the system can provide alerts.

The central controller can further provide track performance metrics of a given crew; a number of work orders completed per shift and a number of railcars handled per shift.

In one configuration, the present system includes a method of tracking rolling stock in a controlled area of a railway system by linking an axle count from an axle counter located in the controlled area and a global sequence identifier to provide an identified axle count; associating the identified axle count with a predetermined axle of a given rolling stock within the controlled area; and displaying a position of at least one of the identified axle count and the given rolling stock in the controlled area.

In an alternative configuration, a method of tracking rolling stock in a controlled area of a railway system is provided by transmitting to a central controller to provide an axle count, a signal corresponding to passage of an axle from at least one of a plurality of networked axle counters in the controlled area; assigning a global sequence identifier to at least a subset of the axle counts; and displaying a location of rolling stock within the controlled area corresponding to the at least subset of axle counts.

Further provided is a method of tracking rolling stock in a controlled area of a railway system by receiving data representing an order of rolling stock in a train entering the controlled area, at least one of the rolling stock being uniquely identified; obtaining an axle count from at least one axle counter in the controlled area; and associating the obtained axle count with the at least one of the railcars within the controlled area.

The disclosed methods also include tracking rolling stock in a controlled area of a railway system, the controlled area including at least one track zone extending between adjacent axle counters, by obtaining a list of rolling stock entering the controlled area and a global sequence identifier associated with at least a subset of rolling stock in the list; identifying a passage of the subset of rolling stock from at least one of the axle counters and associating the passage with a global sequence identifier; and displaying an order of the subset of the rolling stock within the track zone.

A system is disclosed for tracking rolling stock in a controlled area of a railway system, wherein the system includes a plurality of axle counters in the controlled area for determining passage of an axle; a global sequencer assigning a global sequence identifier to the passage of the axle by at least one axle counter in the controlled area; and a central processor configured to provide a display of a location of a piece of rolling stock within the controlled area corresponding to the determined passage of the axle and the assigned global sequence identifier.

BRIEF DESCRIPTION OF THE DRAWING FIGURES

DETAILED DESCRIPTION OF THE INVENTION

Figure 1:
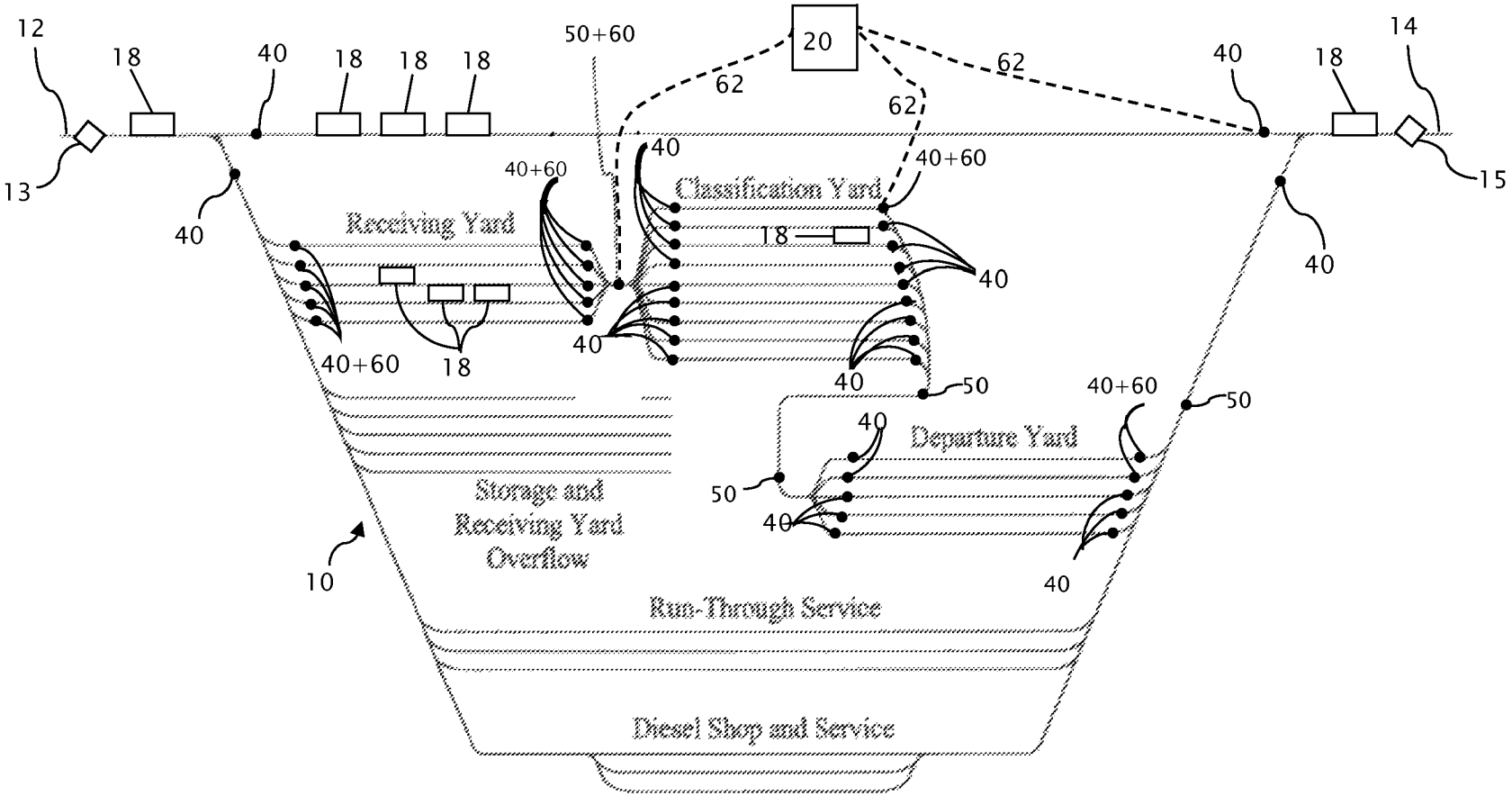
FIG. 1 is a schematic view of a representative track layout, showing a controlled area.

Referring to FIG. 1, a railway system includes a controlled area 10, wherein the controlled area is defined by at least one entrance 12 and one exit 14. For purposes of description, the controlled area 10 is referred to as a yard or switching yard having the entrance 12 and the exit 14. However, it is understood that depending upon the configuration of the controlled area 10, the entrance 12 and the exit 14 can be the same physical point. It is also understood the controlled area 10 may be defined by a plurality of entrances 12 and a plurality of exits 12.

The term rolling stock 18 encompasses the engines, locomotives, carriages, railcars, or other vehicles used on a railway. For purposes of description, these terms are used interchangeably.

The present system includes an entrance portal 13, an exit portal 15, a central controller 20, a plurality of axle counters 40, an optional field controller 50 and a global sequencer 60 for assigning global sequence values or identifiers 62.

In one configuration, each entrance 12 includes one entrance portal 13 and each exit 14 includes one exit portal 15. As set forth above, it is understood the controlled area 10 may include a single portal acting as both an entrance portal and an exit portal. The entrance and exit portals 13, 15 have equipment to detect a train and capture specific data about that train.

The entrance portal 13 and the exit portal 15 can include any of a variety of commercially available products for capturing data representing the trains and/or railcars, such products include an APS Rail OCR portal. The APS Rail OCR portal employs trackside Automatic Equipment Identification (AEI) readers, high-resolution cameras and OCR software, to identify and provide an image and equipment number information of railcars in a passing train. This data is collected and passed to the central controller 20. The captured data can include each railcar ID, the number of axles per railcar, and in those trains having intermodal containers, each container ID and railcar orientation.

Railcar IDs are determined from the AEI (Automatic Equipment Identification) data tags located on each railcar. An AEI reader reads the AEI data tag which is on virtually all North American rolling stock 18. The AEI data tag is a radio transponder that broadcasts a locomotive, freight car, trailer, container, or end-of-train device information to the trackside reader while the train moves passed. Each AEI data tag has information formatted for the particular piece of equipment to which it is attached, and usually includes the equipment type, owner and road number. To virtually eliminate maintenance of the AEI data tag, the tag does not include batteries. The trackside reader retrieves the data tag information by using a radio signal to reflect and modulate the information back to the reader.

In addition to a unique railcar identification number, AEI data tags also provide data that can be translated (via the Umler™ system) into the number of axles for the corresponding railcar. The Umler equipment management information system is an electronic resource of data for North American transportation equipment, including railroad rolling stock.

The Umler system is a central repository for registered rail and intermodal equipment in North America.

For instances when a railcar is missing its AEI data tag or the AEI data tag is damaged, the APS Rail OCR portal can still detect that a railcar has passed through using other means such as the cameras and/or the wheel counter located within the portal. If additional axles are detected between good AEI data tag reads, the APS system can identify the number of "unassigned axles" in ordered consist data.

The present system processes the rolling stock 18 identification information derived from either a database comprising the information, or from a fixed-location RFID AEI reader, or a combination of the two methods. This information provides the system with an ordered lineup of the full train, including engines, and all railcars associated with the train that enters the controlled area 10. The railcars and engines coupled together in a specific order are assigned a train identification number.

As the train passes through the entrance portal 13, an ordered list of railcar IDs and corresponding axle counts will be known. For certain portal configurations, such as the APS Rail OCR portal, the intermodal containers are on each railcar and railcar orientation will also be known.

In one configuration, each entrance portal 13 and exit portal 15 includes at least one of a railcar detector or axle counter 40 and one global sequencer 60.

The global sequencer 60 provides a global sequence value or identifier 62 to sequence associated data, such as an axle count. The global sequencer 60 can be or cooperate with a global positioning system to assign a time stamp or subset of a time stamp to an event or data collection such as an axle count or passage into or out of the controlled area 10—thereby providing an orderable or sequenceable identified axle count. That is, while the global sequence identifier 62 could be all or substantially all of a GPS time stamp, data volume can be reduced by associating only a distinguishing portion or a corresponding value of the GPS time stamp to the respective event (or count). Thus, the global sequencer 60 is associated with the entrance and exit portals 13, 15 so that passage of each entering railcar or axle can be assigned or linked with a global sequence identifier 62. Similarly, each or selected subsets of the counts by the axle counter 40 can be associated with a global sequence identifier 62. Thus, the combination of the global sequence identifier 62 and the particular axle counter 40 or portals 13, 15, each data point can be ordered.

Thus, it is contemplated that a global sequencer 60 can be operably connected to the axle counters 40 or the field controller 50 for providing a global sequence identifier 62 for each relevant data collection.

The plurality of axle counters 40 is located within the controlled area 10 and in communication with the central controller 20. In selected configurations, the field controllers 50 can be in communication between a set of the axle counters 40 and the central controller 20.

Figure 2:
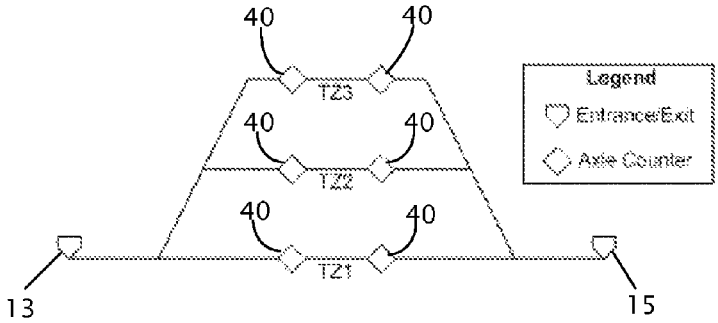
FIG. 2 is a schematic view of a first representative section of track layout within the controlled area showing an additional set of track zones.

As seen in FIG. 2, two axle counters 40 define each track zone TZ1, TZ2, and TZ3 within the controlled area 10. As each of the axle counters 40 is uniquely identified and at a predetermined location, the associated track zone TZ is defined. For purposes of description, two sequentially spaced axle counters 40 are adjacent, even though the axle counters 40 may be separated by as little as 20 feet or as much as a mile or more. Thus, a track zone TZ is defined as the length of track between two adjacent axle counters 40. Alternatively, the area enclosed by two or more adjacent axle counters 40 defines a given track zone TZ. As the present system determines which track zone TZ each piece of rolling stock 18 is located, the placement of the axle counters 40 defines the granularity or resolution of the location for determining where each piece of rolling stock 18 is located within the controlled area 10. It is contemplated that each track zone TZ be designed so that only a single train movement can be occurring in the respective track zone TZ at one time.

FIG. 2 illustrates a minimal axle counter 40 placement to determine the rolling stock 18 location in track zones TZ1, TZ2 and TZ3 for a given layout of track in the controlled area 10.

Figure 3:
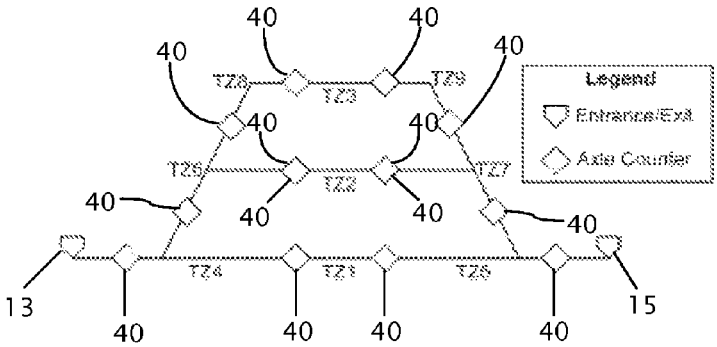
FIG. 3 is a schematic view of the first representative section of track layout within the controlled area showing a different second set of track zones.

As seen in FIG. 3, additional axle counters 40 can be operably located with the given track layout to increase the number of track zones TZ within the controlled area 10 and thus provide increased resolution of the location of a given axle and hence rolling stock 18 within the controlled area 10.

As seen in FIG. 3, there are nine track zones TZ1-TZ9 within the section of the controlled area 10, as opposed to the three track zones TZ1-TZ3 as defined by the axle counters 40 in FIG. 2.

The axle counter 40 can include a train detection device such as, but not limited to an axle counter, a wheel counter, or wheel flange counter or any device capable of sensing the passage of an axle. For purposes of counting passage of railcars or entire pieces of rolling stock 18 a variety of devices can be employed including, but not limited to track circuits, approach circuits, over switch detection circuits, switch position circuits, hot box detectors, high/wide detectors, wheel detectors, crossing detection circuits, station announcers, GPS receivers, computer aided dispatch systems, automatic equipment identifiers, RFID, as well as mainline sensors.

In one configuration, the axle counter 40 is as manufactured or licensed by Introl Design of Lockport N.Y., and contemplated by U.S. Pat. Nos. 6,663,053 and 6,899,303 both of which are hereby expressly incorporated by reference. These devices provide for detecting the presence of a train wheel on a train track, and hence axle count.

The axle counter 40 provides a signal corresponding to passage of an axle or wheel. As set forth above, the signal may directly correspond to the number of axles or may be calculated from the signal of the axle counter 40. Each axle counter 40 is uniquely identified to the central controller 20 (and the field controller 50) such that any signal from a given axle counter 40 is attributable to the respective axle counter.

In selected configurations, field controllers 50 are deployed within the controlled area 10, wherein each field controller is operably connected to a set of axle counters 40. In one configuration, each field controller 50 is operably connected to the central controller 20, either through hard wiring such as RS485 serial communication bus or wireless communication.

In one configuration, each field controller 50 compiles the received counts from the respective set of axle counters 40 and calculates a location result which is transmitted to the central controller 20. The field controller 50 provides a means to compile the railcar count and associate the count with a specific track zone TZ. A communication interface connects the network of axle counters 40 to the field controller 50, which can sum the detection information for each set of axle counters 40 together, and transmits the data to the central controller 20.

It is contemplated the global sequencer 60 can be located at the axle counter 40 such that the data, including an identified axle count (a linked or associated axle count and global sequence identifier 62) is passed from the axle counter to the central controller 20. In such configuration, the axle counter 40 would be operably associated with either a data source or a networked reference to capture an accurate representation of the global sequence identifier 62 at the counter. The global sequencer 60 can employ data from a global positioning system, such as a GPS clock source and thus providing a time stamp for each data point.

However, it is also contemplated that the global sequencer 60 can be located at the field controller 50 such that the data passed from the respective axle counter 40 is associated with a global sequence identifier 62 at the field controller 50, and the data from the field controller 50 to the central controller 20 includes the axle count and an associated global sequence identifier 62.

Alternatively or depending upon the size of the controlled area 10, each axle counter 40 can directly communication with, or through repeaters, the central controller 20.

The central controller 20 can be located at or adjacent to the controlled area 10, or can be remotely located from the controlled area 10 and accessed through any of a variety of networks. The central controller 20 can be any commercially available programmable computer and includes memory for storage of data, as well as a user interface, such as but not limited to a graphical user interface, for presenting resultant calculations or images to the operator and providing for operator input such as by keypad, keyboard, touch screen, pointer, mouse or any other available interface. The central controller 20 can include a module with an embedded processor, multiple serial ports, and discreet inputs and outputs. Communications to the axle counters 40 can be provided by discrete input/output or a serial protocol converter interface. A radio link via a serial port interface can provide the communication interface. In one configuration, one of the serial ports on the central controller 20 is configured for RS485 communication. This RS485 serial port will interface to the axle counters 40 or the respective field controller 50 serial network link between the field controller 50 and the network of axle counters 40.

Figure 4:
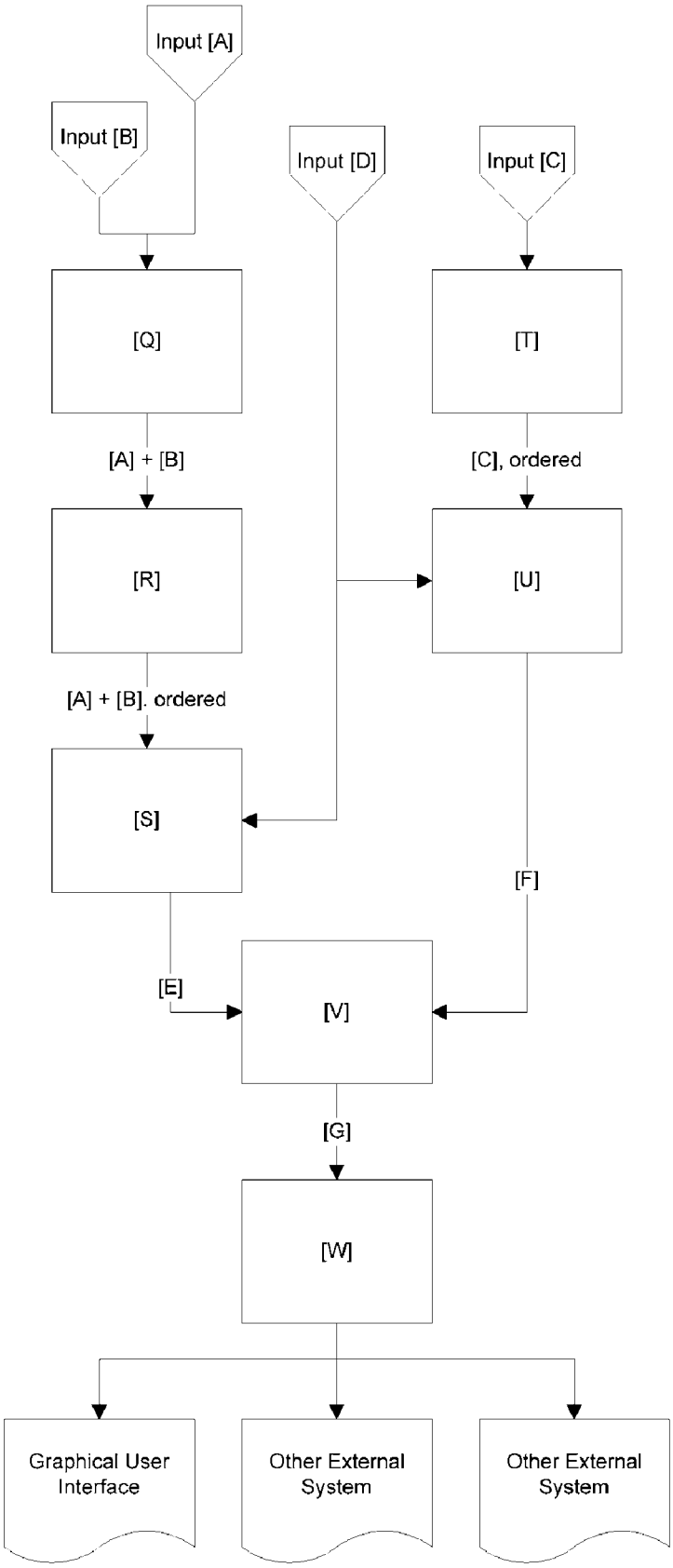
FIG. 4 is a flow chart of the processing of the input data in accordance with the present system.

Referring to FIG. 4, the following data inputs for the present system are provided:

Input [A] is the data representing a list of rolling stock 18 entering the controlled area 10. This data includes a global sequence identifier 62 for each movement entering the controlled area 10. If the controlled area 10 has multiple entrances, a unique identification of each entrance is also included with the data. While the global sequence identifier 62 can be associated with each piece of rolling stock at entry to the controlled area 10, such data is not required. That is, it is only necessary to associate a global sequence identifier 62 for each update or collection of rolling stock 18 entering or exiting the controlled area in a single movement.

Input [A'] is an optional list of rolling stock 18 exiting the controlled area 10. However, if this data is employed, the data includes a global sequence identifier 62 for each movement. If the controlled area 10 has a plurality of exits, an exit identifier is included in the data. It is contemplated that an entrance can be, and often is, the same location as an exit. For purposes of this description, Input [A] refers to both Input [A] and Input [A']. It is further understood that for each input [A] and Input [A'], the list may be in order or out of order.

Input [B] is the necessary axle count of each piece of rolling stock 18 entering the controlled area 10. That is, this input is the number of axles associated with each piece of rolling stock 18 entering the controlled area 10. This data can be provided with the inputs [A] or reside in a separate data source. That is, the axle count of each piece of rolling stock 18 can be obtained from an outside source such as the Umler™ database.

Input [C] is data of a count of the number of axles passing over the respective axle counter 40. Each axle count is assigned a global sequence identifier 62, thus it is understood the order in which the axle counts provided at Input [C] can be in order or out of order. That is, based on operations within the controlled area 10, a minimum sample rate is determined. The sampling rate must be fast enough that to allow the track that the axle (railcar) went down to be determined. The sampling rate is based upon the distance between axle counters 40, a maximum railcar speed in the controlled area 10 and a throw time of a switch. The sampling rate must be short enough that, in a single zone, multiple railcars cannot go down different tracks (exit the zone from different exits) within a cycle (sample period). It is recognized a benefit of a slower sampling rate is a reduced volume of data and hence a reduced network bandwidth is required for transmission of the data. The axle counts are read and stamped (associated with) the global sequence identifier 62 at that given rate. The axle count and associated global sequence identifier 62 (as an identified count) can then be transmitted to the central controller 20 at a later time. As each count is associated with a global sequence identifier 62, any latency (delay) does not impact the accuracy of the tracking.

In one configuration, the central controller 20 polls each axle counter 40. As the central controller 20 polls the axle counter 40, the central controller 20 will listen to the counts from each axle counter 40. As the counts are read by the central controller 20, each count is associated with a global sequence identifier 62 from the global sequencer 60, such as a time stamp using a global positioning system (GPS) clock source. The global sequence identifier 62 can be assigned at the axle counter 40, the field controller 50 or the central controller 20.

The use of a GPS clock source as the global sequencer 60 provides a consistent time stamp relative to all other locations throughout the controlled area 10. Any of a variety of mechanisms can be used to assign the global sequence identifier 62. In one configuration, a GPS time stamp is used as the global sequence identifier 62. In a further configuration, the GPS time stamp can be used to generate the global sequence identifier 62. In this configuration, the global sequence identifier 62 may not provide an associated time but rather merely provide an order with respect to all other global sequence identifiers associated with a count of an axle in the controlled area. An accurate global sequence identifier 62, such as by a time stamp relative to all locations, allows the transmission of the count data from the axle counters 40 (and hence field controller 50) to be received at the central controller 20 in a non-deterministic manner, thus allowing the axle count data received central controller 20 to be out of order. The global sequence identifier 62 allows the axle count data to be sorted into the correct order, thereby determining the tracking of the railcars in the correct order within the controlled area 10 and track zone TZ.

In addition, Input [C] includes a direction of axle movement (or a direction of axle movement is derived from a change in axle count (i.e., count decreases for left movement and increases for right movement)). That is, the direction of movement of the rolling stock relative to the axle counter 40 can be determined by a single sensor as the counts provided by a given counter can be incremented up or down corresponding to the direction of movement relative to the orientation of the counter mounting to the rail. Thus, in Input [C], each axle counter 40 provides a direction.

Similarly data representing a speed of the rolling stock 18 can be input or derived from the signals from two or more axle counters 40 spaced a known distance apart such that when one axle counter triggers and then the spaced axle counter triggers, the difference in trigger times divided by the spacing distance will yield a speed of the rolling stock 18. Alternatively, each axle counter 40 can locally accumulate the counts of the counter and report the accumulated (stored) counts in response to polling, such as over the serial communication bus. However, any determination of speed would depend upon a polling rate of the axle counters 40, number of axle counters and the available transmission rates.

Input [D] is optional operator input, wherein the operator can adjust the location of a piece of rolling stock 18 and/or axles, as well as number of axles per piece of rolling stock 18.

Referring to FIG. 4, Blocks [Q] through [S] can execute in parallel and independently of Blocks [T] through [U] and Blocks [V] through [W]. Blocks [Q] through [S] process the identification of the rolling stock 18 entering or exiting the controlled area 10.

Block [Q] processes Input [A] and Input [B]. If Input [A] is received without Input [B], then Input [B] can be looked up from an external data source, such as the UMLER database, and a number of axles will be associated with each piece of rolling stock 18 in Input [A]. The resultant output is shown as [A]+[B].

Input [A]+[B] can be received either in order or out of order. Block [R] is a buffer and thus provides for the assembling Input [A]+[B] into an ordered list.

Block [S] maintains Input [A]+[B] and processes any user input, Input [D]. That is, as the operator can manually adjust the identification of the rolling stock 18 being tracked in the system, this input imparted to created Input [A]+[B]. In one configuration, Input [A]+[B] is maintained for each entrance 12 and exit 14 to the controlled area 10. The resultant data is referred to as Data [E]. Data [E] is provided to Block [V] for transformation.

Blocks [T] through [U] can execute in parallel and/or independently of Blocks [Q] through [S] and Blocks [V] through [W]. Blocks [T] through [U] counts from the axle counters 40 and track the location of axles in the controlled area 10.

Specifically, Block [T] processes Input [C], wherein Input [C] can be received in order or out of order. As each Input [C] includes a global sequence identifier 62 the order of Input [C] received at the central controller 20 can be any order. Block [T] will buffer and assemble Input [C] into an ordered list of axle counts.

Block [U] is a core processing block in the railcar tracking algorithm. Input [C] is utilized to create and update a map of the location of all the axles in the controlled area 10. The location being the relative position of an axle relative to a different axle within the controlled area 10 and the axle counter 40. Block [U] utilizes the ticket to determine which entrance 12 the axle entered through and the order of the axle in relation to all other axles entering through the given entrance. In one configuration, as each axle enters, or is treated as entering the controlled area 10, the axle is assigned a unique identifier (referred to as a ticket) within the system. It is understood the ticket need only be able to distinguish from other axles within the controlled area 10, and thus once an axle associated with a given ticket exits the controlled area 10, the same ticket can be assigned to a different axle entering the controlled area 10. The axle is then tracked within the controlled area 10 from a first track zone TZ1 to second track zone TZ2 utilizing the data from the axle counters 40 (Input [C]).

Block [U] can also process user input, Input [D]. Input [D] can include an operator adjustment of axle counts in a given first track zone TZ1, as well as a location of a given axle within the controlled area 10. The operator can employ the user interface to move pieces of rolling stock 18 or collections, such that the system will accordingly process this input as axle movement.

One or more snapshots of the resultant axle map are maintained by the system, typically at the central controller 20. In the event late data is received out of order from any of the inputs, Block [U] may revert to a previous snapshot and correct the map based on the newly received data.

The resultant data is referred to as Data [F], wherein Data [F] is provided to Block [V] for transformation.

Blocks [V] through [W] can execute in parallel and independently of Blocks [Q] through [S] and Blocks [T] through [V]. Blocks [V] through [W] employ the counts from the axle counters 40 and track the location of axles in the controlled area 10.

Block [V] is a core processing block in the railcar tracking algorithm. When Data [E] or Data [F] is updated or new data is available, Block [V] will combine the two data streams and calculate the location and optionally orientation of all pieces of rolling stock 18 in the controlled area 10. The resultant data, Data [G], is made available to Block [W]. Thus, Data [G] provides the current location of all the rolling stock 18 in the controlled area 10.

Block [W] makes Data [G] available to other sections of the system and other external systems, such as but not limited to the graphical user interface as well as the APS Rail OCR portal.

That is, as the APS Rail OCR portal does not have visibility of where the railcars go after they pass through the portal, the present system will take over tracking the location of each railcar relative to all other railcars in the controlled area 10.

A further feature can provide a speed of the rolling stock between two axle counters 40. To determine the speed, the field controller 50 interfaces with the two axle counters 40 and determines the direction (as provided above) and time to travel between the counters. The ratio of a known distance between the axle counters 40 and the time to travel provides a measure of the speed.

Based on the data, the present system can thus track railcars anywhere within the track zones of a controlled area 10; map the location of the railcars in near real time or real time; measure switching productivity; highlight all hazardous railcars within the controlled area 10; calculate a dwell time for each individual railcar within the controlled area 10; share a location map with all authorized personnel on a real time basis; optimize railcar inventory within the controlled area 10, thereby reducing demurrage charges; optimize railcar placement within a train; automate railcar flagging for maintenance; improve accuracy of switching (Right Car-Right Train) as well as highlighting "Hot" railcars within the controlled area 10. It is understood the ability to provide "real time" data and updates depends upon accumulation of axle counts, frequency of transmission, and available transmission capacity. Thus, the updates may be within a few seconds of the actual event or on the order of a minute.

In one configuration, as railcars pass through the entrance portal 13, such as the APS Rail OCR portal, the ordered listing of railcar IDs and corresponding axle counts is passed from the entrance portal 13 to the central controller 20. The present system then tracks each railcar ID throughout the controlled area 10. With respect to those railcars providing intermodal transport, such as containers, since the relationship of containers to railcars does not change until the railcar is processed, container data need not be tracked or stored by the present system.

In one configuration for tracking containers or loads of the railcars, an ordered listing of railcar IDs relative to each track will be passed back to the APS system for the purpose of locating the containers. Since the APS system has a correlation of containers to railcars, once the present system provides APS with the relative position of each railcar on a given track, the APS system will know where all of the containers are and specifically which containers are on the processing tracks.

By counting the number of railcars that enter a specific track zone TZ (or switch location), and then by counting the number of railcars that depart from the same track zone TZ, the tracking algorithm can ascertain whether railcars were dropped off or picked up from the track zone TZ. Since the present system requires previous information of the railcars positioned in a track zone TZ, and requires previous information regarding the exact railcar location within a train set, the system tracks railcars with specific identification information as the railcars are switched to and from any track zone TZ. The system operates on the assumption that the railcars cannot change their relative order once they are placed in a track zone TZ.

As an illustration, assume 50 railcars are already placed in a first track zone TZ1 and the system has knowledge of the exact order of each railcar. The railcars are identified as Car #1 through Car #50, with Car #50 at the end of a dead end track, and Car #1 placed closest to a track switch A. Train #EX1 made up of 2 engines and 10 railcars enters the controlled area 10 and the first track zone TZ1, railcars first, with engines shoving railcars into the track zone TZ. The detection equipment detects the following:

a) 12 railcars (10 railcars and 2 engines) enter track zone TZ;

b) 6 railcars depart track zone TZ; and c) The tracking algorithm processes the axle counts and determines 6 new railcars were decoupled from Train #EX1, so there are now 56 railcars left in the first track zone TZ1. The order of railcars has not changed, so every railcar can be exactly identified and tracked.

Thus, the present system accurately determines the location of each piece of rolling stock 18 within the controlled area 10 of the railroad system in a real-time manner utilizing data from the axle counters 40. In addition, the location of each piece of rolling stock 18 is defined as to a specific track zone TZ that the rolling stock 18 is occupying, as well as the order of the axles, and hence railcars, when multiple railcars are occupying a common same track zone TZ. The present system is a real-time or near real time tracking system for rolling stock 18. The system detects, reports, displays and logs the movements of rolling stock 18 while the stock is switched throughout the controlled area 10, such as a rail yard or terminal infrastructure. The system performs the following functions (i) tracking and displaying the relative position of all rolling stock in the controlled area 10 (as the relative position of each railcar within each zone, and the exact or specific zone that each railcar is in) and (ii) providing a graphical playback of railcar movements.

The present system does not require a knowledge of the position of switches within the controlled area 10. However if such switch data is available, the data may be used to further assist in the tracking of rolling stock within the controlled area 10. That is, an axle counter 40 can be provided for each switch or portion of a switch such that the resulting axle counts can be used to locate the respective piece of rolling stock 18.

While the present system is described in terms of axle count, it is understood that a count of any parameter of the rolling stock 18 that can be corresponded to axles can be employed, whether in combination with additional information (such as axles per railcar) or directly corresponding such as each wheel count along one rail directly corresponds to one axle.

The invention has been described in detail with particular reference to a presently preferred embodiment, but it will be understood that variations and modifications can be effected within the spirit and scope of the invention. The presently disclosed embodiments are therefore considered in all respects to be illustrative and not restrictive. The scope of the invention is indicated by the appended claims, and all changes that come within the meaning and range of equivalents thereof are intended to be embraced therein.

The invention claimed is:

1. A method of tracking rolling stock in a controlled area of a railway system, the method comprising:

(a) linking an axle count from an axle counter located in the controlled area and a global sequence identifier to provide an identified axle count;

(b) associating the identified axle count with a predetermined axle of a given rolling stock within the controlled area; and (c) displaying a position of at least one of the identified axle count and the given rolling stock in the controlled area.

2. The method of claim 1, further comprising displaying a position of the at least one of the identified axle count and the given rolling stock relative to the axle counter.

3. The method of claim 1, further comprising displaying a position of the at least one of the identified axle count and the given rolling stock relative to a track zone in the controlled area.

4. The method of claim 1, further comprising associating the given rolling stock with a railcar identifier.

5. The method of claim 1, further comprising comparing the identified axle count and a unique railcar identification with a secondary source.

6. The method of claim 5, wherein the secondary source is an entrance portal.

7. The method of claim 1, wherein the global sequence identifier is derived from a GPS time stamp.

8. The method of claim 1, further comprising determining at least one of (i) a location of a first predetermined axle relative to a second predetermined axle in the controlled area, (ii) a direction of travel of the first predetermined axle, and (iii) a location of the first predetermined axle relative to a track zone within the controlled area.

9. A method of tracking rolling stock in a controlled area of a railway system, the method comprising:

(a) transmitting to a central controller to provide an axle count, a signal corresponding to passage of an axle from at least one of a plurality of networked axle counters in the controlled area;

(b) assigning a global sequence identifier to at least a subset of the axle counts; and (c) displaying a location of rolling stock within the controlled area corresponding to the at least subset of axle counts.

10. The method of claim 9, wherein transmitting to a central controller to provide an axle count a signal corresponding to passage of an axle from at least one of a plurality of networked axle counters in the controlled area includes transmitting the signal from the at least one of the plurality of networked axle counters to a field controller, processing the signal at the field controller and transmitting a corresponding signal to the central controller.

11. The method of claim 10, further comprising transmitting the global sequence identifier from the field controller to the central controller.

12. The method of claim 10, further comprising assigning the global sequence identifier at the field controller.

13. The method of claim 9, further comprising assigning the global sequence identifier at the respective axle counter.

14. The method of claim 9, further comprising employing a time stamp as the global sequence identifier.

15. A method of tracking rolling stock in a controlled area of a railway system, the method comprising:

(a) receiving data representing an order of rolling stock in a train entering the controlled area, at least one of the rolling stock being uniquely identified;

(b) obtaining an axle count from at least one axle counter in the controlled area; and (c) associating the obtained axle count with the at least one of the rolling rock within the controlled area.

16. The method of claim 15, further comprising displaying a location of the at least one of the rolling stock relative to the at least one axle counter in the controlled area.

17. The method of claim 15, further comprising associating a global sequence identifier with the obtained axle count.

18. A system for tracking rolling stock in a controlled area of a railway system, the system comprising:

(a) a plurality of axle counters in the controlled area for determining passage of an axle;

(b) a global sequencer assigning a global sequence identifier to the passage of the axle by at least one axle counter in the controlled area; and (c) a central processor configured to provide a display of a location of a piece of rolling stock within the controlled area corresponding to the determined passage of the axle and the assigned global sequence identifier.

19. The system of claim 18, further comprising a field controller in communication with the plurality of axle counters, the field controller including the global sequencer.

20. A method for tracking rolling stock in a controlled area of a railway system, the controlled area including at least one track zone extending between adjacent axle counters, the method comprising:

(a) obtaining a list of rolling stock entering the controlled area and a global sequence identifier associated with at least a subset of rolling stock in the list;

(b) identifying a passage of the subset of rolling stock from at least one of the axle counters and associating the passage with a global sequence identifier; and (c) displaying an order of the subset of the rolling stock within the track zone.

21. The method of claim 20, further comprising transmitting a signal corresponding to the passage of the subset of rolling stock from the at least one of the axle counters.

22. The method of claim 20, further comprising assigning a ticket to each axle entering the controlled area.

23. The method of claim 22, wherein the ticket uniquely identifies the axle relative to the remaining axles within the controlled area.

* * * * *